US009067302B2

(12) United States Patent
Chou et al.

(10) Patent No.: US 9,067,302 B2
(45) Date of Patent: Jun. 30, 2015

(54) SEGMENT-TYPE CHEMICAL MECHANICAL POLISHING CONDITIONER AND METHOD FOR MANUFACTURING THEREOF

(71) Applicant: Kinik Company, Taipei (TW)

(72) Inventors: Jui-Lin Chou, Hualien County (TW); Chia Chun Wang, New Taipei (TW); Chia-Feng Chiu, New Taipei (TW); Chung-Yi Cheng, New Taipei (TW)

(73) Assignee: KINIK COMPANY, Taipei (TW)

( * ) Notice: Subject to any disclaimer, the term of this patent is extended or adjusted under 35 U.S.C. 154(b) by 0 days.

(21) Appl. No.: 14/212,224

(22) Filed: Mar. 14, 2014

(65) Prior Publication Data

US 2014/0273773 A1 Sep. 18, 2014

(30) Foreign Application Priority Data

Mar. 15, 2013 (TW) ..... 102109202 A

(51) Int. Cl.
*B24B 53/00* (2006.01)
*B24B 53/017* (2012.01)
*B24D 18/00* (2006.01)

(52) U.S. Cl.
CPC ..... *B24B 53/017* (2013.01); *B24D 18/00* (2013.01)

(58) Field of Classification Search
CPC ..... B24B 53/017; B24B 53/12; B24B 37/04; B24D 3/06; B24D 18/00
USPC ..... 451/443, 56, 444, 548–551; 51/298
See application file for complete search history.

(56) References Cited

U.S. PATENT DOCUMENTS

| | | | | |
|---|---|---|---|---|
| 5,076,024 | A * | 12/1991 | Akagawa et al. | 451/550 |
| 5,626,509 | A * | 5/1997 | Hayashi | 451/285 |
| 6,106,382 | A * | 8/2000 | Sakaguchi | 451/443 |
| 6,142,859 | A * | 11/2000 | Ross et al. | 451/443 |
| 6,213,856 | B1 * | 4/2001 | Cho et al. | 451/443 |
| 6,293,854 | B1 * | 9/2001 | Kimura et al. | 451/56 |
| 6,347,981 | B1 * | 2/2002 | Holzapfel | 451/56 |
| 6,361,423 | B2 * | 3/2002 | Gurusamy et al. | 451/443 |
| 8,342,910 | B2 * | 1/2013 | Dinh-Ngoc et al. | 451/56 |
| 8,393,934 | B2 * | 3/2013 | Sung | 451/56 |
| 8,398,466 | B2 * | 3/2013 | Sung et al. | 451/443 |
| 2004/0048557 | A1 * | 3/2004 | Nabeya | 451/56 |
| 2004/0110453 | A1 * | 6/2004 | Barnett, III | 451/56 |
| 2004/0203325 | A1 * | 10/2004 | Donohue | 451/56 |
| 2005/0202762 | A1 * | 9/2005 | Nabeya | 451/56 |
| 2006/0079160 | A1 * | 4/2006 | Balagani et al. | 451/285 |
| 2008/0153398 | A1 * | 6/2008 | Sung | 451/56 |
| 2011/0275288 | A1 * | 11/2011 | Sung | 451/56 |

* cited by examiner

*Primary Examiner* — George Nguyen
(74) *Attorney, Agent, or Firm* — Muncy, Geissler, Olds & Lowe, P.C.

(57) ABSTRACT

The present invention relates to a segment-type chemical mechanical polishing conditioner and a method for manufacturing thereof. The segment-type chemical mechanical polishing conditioner comprises: a bottom substrate having a center protrusion; an abrasive unit binding layer disposed on the outside of the surface of the bottom substrate; and a plurality of abrasive units placed on the abrasive unit binding layer; wherein the abrasive units have a fan-shaped contour and are arrange along the center protrusion of the bottom substrate to form a discontinuous circular contour. Therefore, the present invention can utilize the center protrusion of the bottom substrate to adjust the arrangements of the abrasive units, and effectively improve the problem of thermal deformation of the surface of the chemical mechanical polishing conditioner during heat-hardening process, thereby enhancing the surface flatness of chemical mechanical polishing conditioner.

19 Claims, 4 Drawing Sheets

SEGMENT-TYPE CHEMICAL MECHANICAL POLISHING CONDITIONER AND METHOD FOR MANUFACTURING THEREOF

CROSS REFERENCE TO RELATED APPLICATION

This application claims the benefits of the Taiwan Patent Application Serial Number 102109202, filed on Mar. 15, 2013, the subject matter of which is incorporated herein by reference.

BACKGROUND OF THE INVENTION

1. Field of the Invention

The present invention relates to a chemical mechanical polishing conditioner and a method for manufacturing thereof, and more particularly to a chemical mechanical polishing conditioner which may provide a deformation compensation for an abrasive layer.

2. Description of Related Art

Chemical mechanical polishing (CMP) is a common polishing process in various industries, which can be used to grind the surfaces of various articles, including ceramics, silicon, glass, quartz, or a metal chip. In addition, with the rapid development of integrated circuits, chemical mechanical polishing becomes one of the common techniques for wafer planarization due to its ability to achieve global planarization.

During the chemical mechanical polishing process of semiconductor, impurities or uneven structure on the surface of a wafer are removed by contacting the wafer (or the other semiconductor elements) with a polishing pad and using a polishing liquid if necessary, through the chemical reaction and mechanical force. When the polishing pad has been used for a certain period of time, the polishing performance and efficiency are reduced because the debris produced in the polishing process may accumulate on the surface of the polishing pad. Therefore, a conditioner can be used to condition the surface of the polishing pad, such that the surface of the polishing pad is re-roughened and maintained at an optimum condition for polishing. In the process for manufacturing a conditioner, it is necessary to dispose an abrasive layer by mixing abrasive particles and a binding layer on the substrate surface, and to fix the abrasive layer to the surface of the substrate by brazing or sintering methods. However, during curing the abrasive layer, the surface of the substrate may be deformed because of the difference in thermal expansion coefficient between the abrasive layer and the substrate, thus destroying flatness of the abrasive particles of the conditioner and thereby adversely affecting the polishing efficiency and service life of the conditioner.

In the known technology, it discloses an abrasive cloth dresser and a method for dressing an abrasive cloth with the same; wherein the dresser is aiming at an abrasive cloth dresser having a ring-shaped dressing face in the outer region of the base metal. The first abrasive grain units and the second abrasive grain units formed of abrasive grains with different grain sizes from each other are alternately arranged on the dressing face. The base metal includes adjusters for arbitrarily adjusting the height difference delta between reference planes and of the respective abrasive grain units, and the reference planes each include the ends of the abrasive grains with the largest grain size. However, the different degrees of high differences must be combined and adjusted by the adjusters, such as a base, a screw, a screw hole and so on through a mechanical method in the known technology.

Besides, in the other known technology, it discloses an assembled grinding machine, including: a big substrate, a plurality of elastic elements and a plurality of grinding units. Each of the plurality of the grinding units includes a plurality of grounding particles. Each of the grounding particles has a cutting end. The grinding units are coupled to the large substrate, respectively. The elastic elements are arranged between the grinding units and the big substrate, so that the elastic units can adjust the cutting end exceeding the big substrate. The grinding units are respectively coupled on the big substrate, so that the cutting ends of the abrasive particles on a big assembled grinding machine can have the same height. It is a low cost that the big grinding machine can be assembled by a plurality of small grinding units through different grinding particles optionally.

However, in the above-mentioned assembled chemical mechanical grinding machine, it is necessary to fix the grinding units to the bottom substrate by the adjusters. Besides, the tips of each grinding unit on the chemical mechanical polishing conditioner may result in the high differences due to the mechanical combination method. Therefore, the surface flatness of the chemical mechanical polishing conditioner is not easily controlled. On the other hand, if the grinding units are embedded and fixed to the holes of the bottom substrate, the bottom substrate of the chemical mechanical polishing conditioner is deformed after curing because of the differences in the thermal expansion coefficient between the grinding units and the bottom substrate. Furthermore, the surface of the chemical mechanical polishing conditioner is deformed therewith, and the flatness of the grinding particles on the surface of the conditioner is destroyed.

Therefore, what is needed is to develop a chemical mechanical polishing conditioner with surface flatness, which cannot only solve the deformation of the abrasive layer of the chemical mechanical polishing conditioner during curing, but also improve the surface flatness of the chemical mechanical polishing conditioner.

SUMMARY OF THE INVENTION

An object of the present invention is to provide a segment-type chemical mechanical polishing conditioner to solve the surface deformation of the substrate of the chemical mechanical polishing conditioner during curing and molding processes, so as to achieve the surface flatness of the chemical mechanical polishing conditioner. Besides, a discontinuous circular contour is formed by arranging the abrasive units on the bottom substrate in the present invention; therefore, a polishing liquid having a more uniform distribution effect may be provided by a design of the discontinuous circular contour. Meanwhile, the chemical mechanical polishing conditioner having a more excellent ability for discharging debris is provided.

To achieve the above object, the present invention provides a segment-type chemical mechanical polishing conditioner, comprising: a bottom substrate having a center protrusion; an abrasive unit binding layer disposed on the outside of the surface of the bottom substrate; and a plurality of abrasive units disposed on the abrasive unit binding layer; wherein the abrasive units have a fan-shaped contour and are arranged along the center protrusion of the bottom substrate to form a discontinuous circular contour. The present invention is different from a design of a conventional abrasive layer with a single whole surface. In the segment-type chemical mechanical polishing conditioner of the present invention, the abrasive layer of the surface of the chemical mechanical polishing conditioner is design in a plurality of discontinuous circular abrasive units. Therefore, in a method for manufacturing the segment-type chemical mechanical polishing conditioner of the present invention, the abrasive particles may be first fixed and combined to the abrasive unit substrate to form the abrasive units with small sizes, and then reach abrasive unit is stuck on the bottom substrate by an abrasive unit binding layer. The segment-type chemical mechanical polishing conditioner of the present invention can avoid a deformation of the bottom substrate of the chemical mechanical polishing conditioner after curing due to the difference in the thermal expansion coefficient between the abrasive layer and the bottom substrate, and the surface of the chemical mechanical polishing conditioner is deformed therewith, thereby destroying the flatness of abrasive particles on the conditioner. On the other hand, in the segment-type chemical mechanical polishing conditioner of the present invention, because the bottom substrate has a design of center protrusion, the abrasive unit may be fixed and arranged more easily to a predetermined position by a design of the center protrusion, in an arrangement process for installing the abrasive unit to the bottom substrate, or in a heat-curing process of the abrasive unit binding layer. Meanwhile, a displacement of the abrasive unit occurred in the heat-curing process can avoid. On the other hand, in the segment-type chemical mechanical polishing conditioner of the present invention, the arrangement position and the spacing of the abrasive unit are controlled by a locating tool and locating blocks thereof, so that the abrasive unit can correspond with the predetermined arrangements and patterns.

In the segment-type chemical mechanical polishing conditioner of the present invention, the amounts for segmenting the abrasive unit on the surface of the abrasive unit binding layer may be randomly varied based on the polishing processing requirements or a size of the abrasive unit; wherein if the abrasive units are design in smaller sizes, more abrasive units are stuck on the abrasive unit binding layer; meanwhile the surface flatness of the respective abrasive units are more easily controlled. If the abrasive units are designed in a larger size, a smaller number of the abrasive units are stuck on the surfaces of the abrasive unit binding layer; meanwhile it is more simple and convenient process that the abrasive units are stuck on the bottom substrate. In one aspect of the present invention, the surfaces of the abrasive unit binding layers may have four to fifty abrasive units. In another aspect of the present invention, the surfaces of the abrasive unit binding layers may have eight to twelve abrasive units. In the other aspect of the present invention, the surfaces of the abrasive unit binding layers may have eight abrasive units, but the present invention is not limited thereto.

In the segment-type chemical mechanical polishing conditioner of the present invention, the sizes or contours of the abrasive units may be randomly varied based on the polishing processing requirements; wherein the abrasive unit may has a fan-shaped contour based on the above-mentioned contents, and are arranged along the center protrusion of the bottom substrate to form a discontinuous circular contour. In the above-mentioned segment-type chemical mechanical polishing conditioner, the abrasive units may have a positive camber and a negative camber; wherein in one aspect of the present invention, a width between the positive camber and the negative camber may be 5 mm to 20 mm. In another aspect of the present invention, the width between the positive camber and the negative camber may be 8 mm to 14 mm. In the other aspect of the present invention, the width between the positive camber and the negative camber may be 10 mm, but the present invention is not limited thereto.

In the segment-type chemical mechanical polishing conditioner of the present invention, the sizes or contours of the bottom substrates may be randomly varied based on the polishing processing requirements; in one aspect of the present invention, a diameter of the bottom substrate may be 70 mm to 200 mm. In another aspect of the present invention, the diameter of the bottom substrate may be 80 mm to 120 mm. In the other aspect of the present invention, the diameter of the bottom substrate may be 100 mm, but the present invention is not limited thereto.

In the segment-type chemical mechanical polishing conditioner of the present invention, the bottom substrate has a center protrusion, so that these abrasive units are arranged along the center protrusion of the bottom substrate to form a discontinuous circular contour. Further, the abrasive units may be used to adjust the arrangement positions thereof by the center protrusion of the bottom substrate, so that the abrasive units may be fixed to the predetermined positions and be arranged; wherein in one aspect of the present invention, a height of the center protrusion may be ⅕ to ⅘ of a height of the abrasive units. In another aspect of the present invention, the height of the center protrusion may be ¼ to ¾ of the height of the abrasive units. In the other aspect of the present invention, the height of the center protrusion may be ⅔ of the height of the abrasive units, but the present invention is not limited thereto.

In the segment-type chemical mechanical polishing conditioner of the present invention, each abrasive unit may has a plurality of abrasive particles, an abrasive particle binding layer, and an abrasive unit substrate; wherein the abrasive particles embedded in the abrasive particle binding layer, and the abrasive particles may be fixed to the abrasive unit substrate by the abrasive particle binding layer.

In the segment-type chemical mechanical polishing conditioner of the present invention, the abrasive particles may be artificial diamond, nature diamond, polycrystalline diamond or cubic boron nitride. In a preferred aspect of the present invention, the abrasive particles may be diamond. Furthermore, in the segment-type chemical mechanical polishing conditioner of the present invention, the abrasive particles may have a particle size of 30 to 600 μm. In a preferred aspect of the present invention, the abrasive particles may have a particle size of 200 μm.

In the segment-type chemical mechanical polishing conditioner of the present invention, the materials of the abrasive particle binding layer or the abrasive unit binding layer may be varied based on polishing processing requirements or the polishing conditions; wherein the materials thereof may be a brazing layer, a resin layer, an electroplating layer, or a ceramic layer. In a preferred aspect of the present invention, the abrasive particle binding layer may be a brazing layer; wherein the brazing layer may be at least one selected from the group consisting of iron, cobalt, nickel, chromium, manganese, silicon, aluminum, and combinations thereof. Further, in another preferred aspect of the present invention, the abrasive unit binding layer may be a resin layer, and the resin layer may be an epoxy resin.

Another object of the present invention is to provide a method for manufacturing the segment-type chemical mechanical polishing conditioner to manufacture the above-mentioned segment-type chemical mechanical polishing conditioner, so that a problem of surface deformation of the chemical mechanical polishing conditioner occurred in a hardening and molding processes may be solved to achieve surface flatness of the chemical mechanical polishing conditioner. Furthermore, the polishing liquid having a more uniform arrangement effect may be provided by a discontinuous arrangement design; meanwhile the chemical mechanical polishing conditioner having more excellent ability for discharging debris is provided.

To achieve the above object, the present invention is to provide a method for manufacturing the segment-type chemical mechanical polishing conditioner, comprising: providing a bottom substrate having a center protrusion; providing an abrasive unit binding layer disposed on the outside of the surface of the bottom substrate; disposing a locating tool having a plurality of locating blocks on the center protrusion; providing a plurality of abrasive units arranged on the abrasive unit binding layer by the locating tool; heating and curing the abrasive unit binding layer to fix the abrasive units to the abrasive unit binding layer; and removing the locating tool to form a segment-type chemical mechanical polishing conditioner; wherein the abrasive units have a fan-shaped contour and are arranged along the center protrusion of the bottom substrate to form a discontinuous circular contour. The present invention is different from a conventional abrasive layer having a design of single surface. In the method for manufacturing the segment-type chemical mechanical polishing conditioner of the present invention, the abrasive layer of the surface of the chemical mechanical polishing conditioner is designed in a plurality of discontinuous circular abrasive units. Therefore, in a process for manufacturing the segment-type chemical mechanical polishing conditioner of the present invention, the abrasive particles may be first fixed to the abrasive unit substrate to form abrasive units having small sizes, and then each abrasive unit is stuck on the bottom substrate by an abrasive unit binding layer. Furthermore, the method for manufacturing the segment-type chemical mechanical polishing conditioner of the present invention may avoid deformation of the bottom substrate of the chemical mechanical polishing conditioner after curing due to differences in thermal expansion coefficient difference between the abrasive layer and the bottom substrate, and the surface of the mechanical polishing conditioner also deforms therewith, thereby destroying the surface flatness of the surface of the conditioner. On the other hand, in the method for manufacturing the segment-type chemical mechanical polishing conditioner, because the bottom substrate has a design of a center protrusion, the abrasive unit may be fixed and arranged more easily in a predetermined position by a design of the center protrusion, in an arrangement process for installing the abrasive unit to the bottom substrate, or in a heat-curing process of the abrasive unit binding layer. Meanwhile, a displacement of the abrasive unit occurred in the heat-curing process can avoid. On the other hand, in the method for manufacturing the segment-type chemical mechanical polishing conditioner, the arrangement position and the spacing of the abrasive unit may be controlled by a locating tool and locating blocks thereof, so that the abrasive units can correspond with the predetermined arrangements and patterns.

In the method for manufacturing the segment-type chemical mechanical polishing conditioner of the present invention, each abrasive unit may have a plurality of abrasive particles, an abrasive particle binding layer, and an abrasive unit substrate; wherein the abrasive particles are embedded in the abrasive particle binding layer, and the abrasive particles may be fixed to the abrasive unit substrate by the abrasive particle binding layer.

In the method for manufacturing the segment-type chemical mechanical polishing conditioner of the present invention, the methods for heat-curing the above-mentioned abrasive unit binding layer or the abrasive particle binding layer may be brazing method, heat-curing method, ultraviolet radiation curing method, electroplating method, or sintering method. In a preferred aspect of the present invention, the abrasive particle binding layer may be a brazing layer; wherein the brazing layer may be at least one selected from the group consisting of iron, cobalt, nickel, chromium, manganese, silicon, aluminum, and combinations thereof, and the method for heat-curing the abrasive particle binding layer may be brazing method. In another preferred aspect of the present invention, the abrasive unit binding layer may be a resin layer, and the resin layer is an epoxy resin, further, the method for heat-curing the abrasive particle binding layer may be heat-curing.

In summary, according to the segment-type chemical mechanical polishing conditioner and the method for manufacturing thereof of the present invention, the problem of the deformation of the surface of the chemical mechanical polishing conditioner during a process of heat-hardening may be effectively solved, and the surface flatness of the surface of the chemical mechanical polishing conditioner may be improved, thereby increasing the polishing efficiency and service life of the conditioner.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENT

Hereinafter, the actions and the effects of the present invention will be explained in more detail via specific examples of the invention. However, these examples are merely illustrative of the present invention and the scope of the invention should not be construed to be defined thereby.

Comparative Example

Figure 1A:
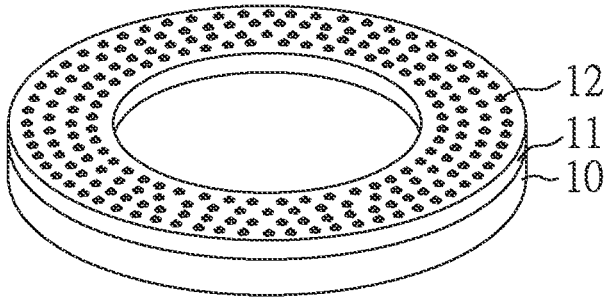
FIGS. 1A to 1C show a schematic diagram of a conventional chemical mechanical polishing conditioner.
Figure 1B:
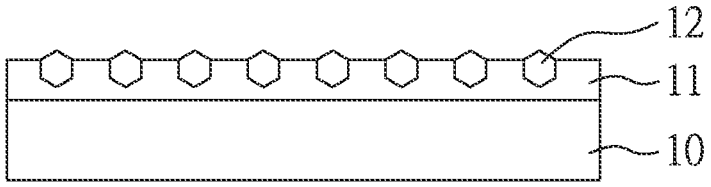
Figure 1C:
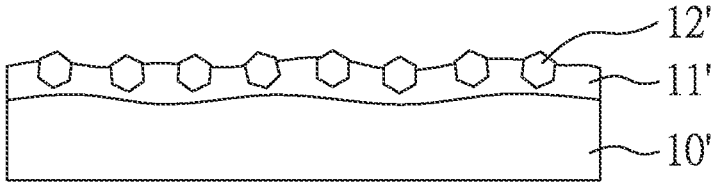

Please refer to FIGS. 1A to 1D, a schematic diagram of a conventional chemical mechanical polishing conditioner is shown. First, as shown in FIGS. 1A and 1B, an abrasive particle binding layer 11 is formed on a working surface of a bottom substrate 10; wherein the bottom substrate 10 may be designed in a central concave circular disk, and the bottom substrate may be designed in a whole planar circular based on the polishing processing requirements. Furthermore, the abrasive particles 12 are embedded in the abrasive particle binding layer 11 by using a known diamond distribution technique, for example, template distribution. The spacing and arrangement of the abrasive particles 12 may be controlled by the template (not shown in figure). Finally, the abrasive particles 12 are fixed to the surface of the bottom substrate 10 by performing a heat-hardening process through the abrasive particle binding layer 11. Please refer to FIG. 1C, the bottom substrate 10' of the chemical mechanical polishing conditioner is deformed after hardening because of the differences in a thermal expansion coefficient of the abrasive particle binding layer 11' and a thermal expansion coefficient of the bottom substrate 10'. Therefore, the abrasive particle binding layer 12 and the abrasive particles 13' on the surface of the bottom substrate 10' are deformed therewith, thereby destroying the flatness of tips of the abrasive particles 13' on the surface of the conditioner.

In the conventional chemical mechanical polishing conditioner of above-mentioned comparative example, the abrasive particle binding layers 11 or 11' are common nickel-based metallic brazing materials, the bottom substrates 10 or 10' are stainless steel materials, and the abrasive particles 12 or 12' are common artificial diamonds.

Example 1

Figure 2A:
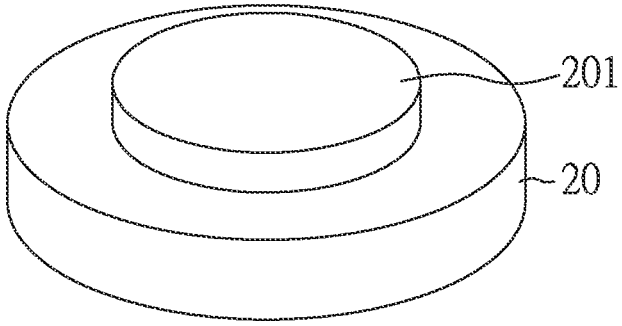
FIGS. 2A, 2B, 2C, 2C', 2D and 2E show a flow diagram for manufacturing a segment-type chemical mechanical polishing conditioner of example 1 of the present invention.
Figure 2B:
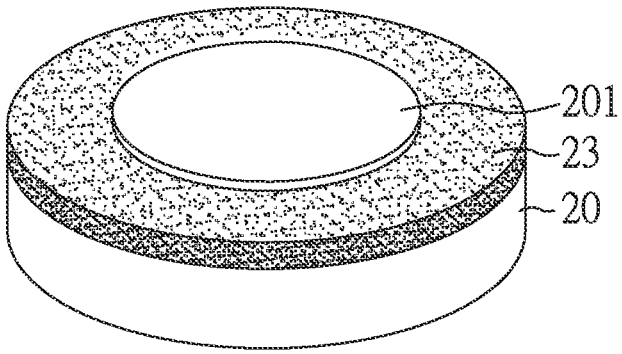
Figure 2C:
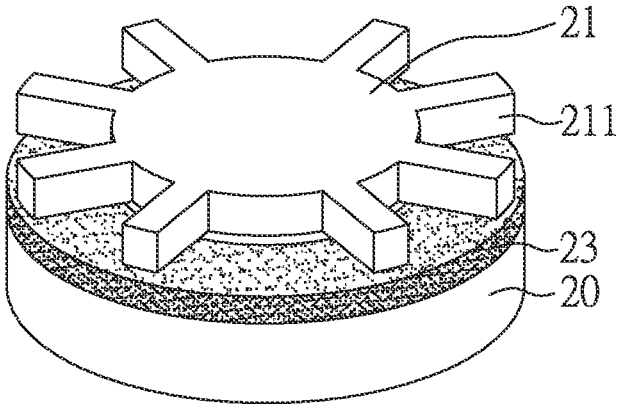
Figure 2C:
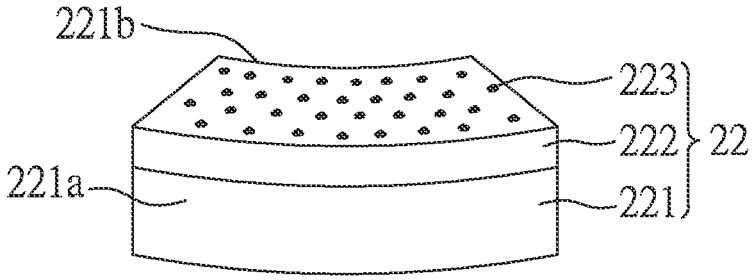
Figure 2D:
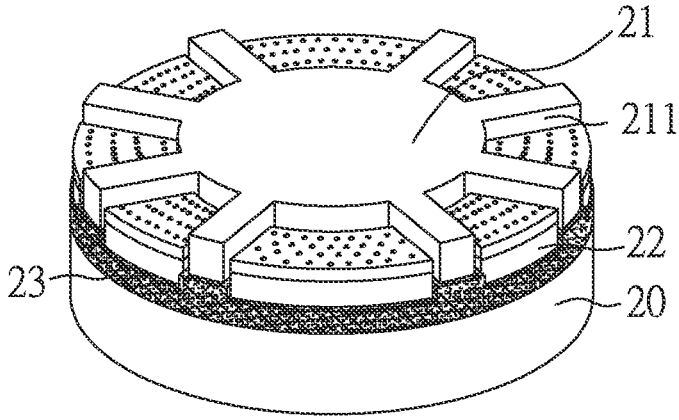
Figure 2E:
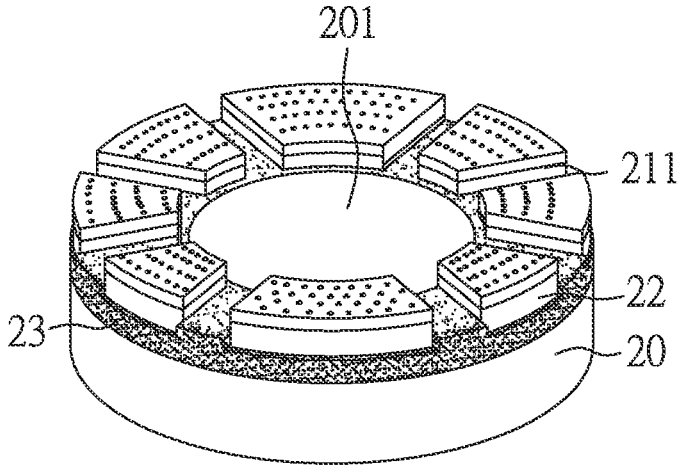

Please refer to FIGS. 2A to 2E, a flow diagram for manufacturing a segment-type chemical mechanical polishing conditioner of example 1 of the present invention is shown. First, as shown in FIG. 2A, a bottom substrate 20 is provided; wherein the bottom substrate 20 has a center protrusion 201. Furthermore, an abrasive unit binding layer 23 is disposed on the outside of surface of the bottom substrate 20; wherein the abrasive unit binding layer 23 is made of epoxy resin and is formed on the outside of surface of the bottom substrate 20 by a common coating method, and the epoxy resin may be preheated if necessary, so that the epoxy resin becomes a half-hardened state, as shown in FIG. 2B. Furthermore, a locating tool 21 is disposed on the center protrusion 201 of the bottom substrate 20, and the locating tool 21 has a plurality of locating blocks 211, as shown in FIG. 2C, and then a plurality of abrasive units 22 are provided, so that the abrasive units 22 are arranged on the abrasive unit binding layer 23 by the locating tool 21. Further, the arranging spaces of abrasive units 22 may be adjusted by the locating block 211 of the locating tool 21, as shown in FIG. 2D. Finally, as shown in FIG. 2E, the abrasive unit binding layer 23 is heated and cured, so that the abrasive units are combined and fixed to the abrasive unit binding layer 23 and the locating tool 21 is removed to form a segment-type chemical mechanical polishing conditioner; wherein the abrasive units 22 may be fixed and combined to the abrasive unit binding layer 23 through heating and hardening methods. In the above-mentioned segment-type chemical mechanical polishing conditioner, the abrasive units 22 have a fan-shaped contour and are arranged along the center protrusion 201 of the bottom substrate 20 to form a discontinuous circular contour. In addition, in the segment-type chemical mechanical polishing conditioner of the present invention, the arrangement position of the abrasive units 22 may be adjusted by the center protrusion 201 of the bottom substrate 20 and the locating blocks 211 of the locating tool 21. The surface of the bottom substrate 20 has eight abrasive units 22 which are arranged to form a discontinuous circular contour, and a diameter of the bottom substrate 20 is 100 mm. A height of the center protrusion 201 is a height of the abrasive units 22 of ⅔.

The present invention is different from the conventional abrasive layer having designs of a discontinuous circular contour or a single whole surface. In the segment-type chemical mechanical polishing conditioner of the present invention, because the abrasive layer of the surface of the chemical mechanical polishing conditioner is designed in a plurality of discontinuous circular abrasive units 22; therefore, in the process for manufacturing the segment-type chemical mechanical polishing conditioner, please refer to FIGS. 2C' and 2D, the abrasive particles 223 may be fixed and combined to the abrasive unit substrate 221 by the abrasive particle binding layer 222 to form the abrasive units 22 having small sizes, and then each abrasive unit 22 is stuck on the bottom substrate 20 by the abrasive unit binding layer 23. In the example 1, the abrasive particle binding layer 222 is a common nickel-based metallic brazing material; therefore, the abrasive particles 223 may be fixed and combined to the abrasive unit substrate 221 to form the abrasive unit 22 having a small size through a hard-brazing method. In addition, the abrasive particles have a positive camber 221*a* and a negative camber 221*b*, and a width between a negative camber 221*b* and positive camber 221*a* is 10 mm. The abrasive particles are common artificial diamonds, and the abrasive particles 223 have the particle sizes of 200 μm, as well as the bottom substrate 20 and the abrasive unit substrate 221 are stainless steel materials.

Figure 3:
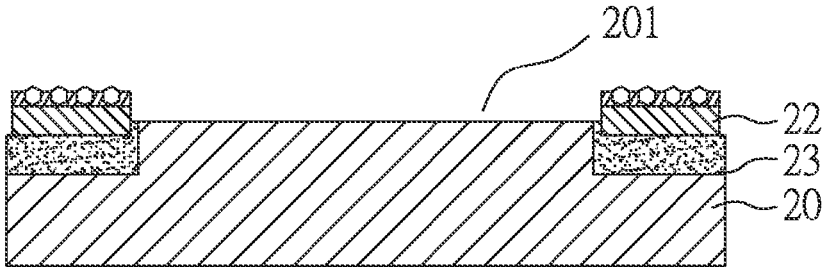
FIG. 3 show a schematic diagram of the chemical mechanical polishing conditioner of example 1 of the present invention.

Then, please refer to FIG. 3, a schematic diagram of the chemical mechanical polishing conditioner of example 1 of the present invention is shown. In the segment-type chemical mechanical polishing conditioner of the present invention, the segment-type chemical mechanical polishing conditioner comprises: a bottom substrate having a center protrusion 201; a plurality of abrasive units 22 disposed on the bottom substrate 20; and an abrasive unit binding layer 23 disposed between the abrasive units 22 and the bottom substrate 20 or disposed between the abrasive units 22; wherein the abrasive units have a fan-shaped contour and are arranged along the center protrusion 201 of the bottom substrate 20 to form a discontinuous circular contour, please refer to FIGS. 3 and 2E. The present invention is different form the conventional abrasive layer having a design of a single whole surface. In the segment-type chemical mechanical polishing conditioner of the present invention, the arrangement positions of the abrasive units 22 may be adjusted by the center protrusion 201 of the bottom substrate 20 and the locating blocks 211 of the locating tool 21. In addition, the abrasive layer on the surface of the chemical mechanical polishing conditioner is designed in a plurality of discontinuous circular abrasive units 22. Therefore, in a process of manufacturing the segment-type chemical mechanical polishing conditioner of the present invention, the abrasive particles 223 are first fixed and combined to the abrasive unit substrate to form the abrasive units having small sizes, and then each abrasive unit is stuck on the bottom substrate by an abrasive unit binding layer 222. Hence, the segment-type chemical mechanical polishing conditioner of the present invention may avoid a deformation occurred in the bottom substrate of the chemical mechanical polishing conditioner after hardening due to the difference in the thermal expansion coefficient between the abrasive layer and the bottom substrate 20, and the surface of the chemical mechanical polishing conditioner is deformed therewith, thereby destroying the flatness of the conditioner.

Example 2 and Example 3

Figure 4A:
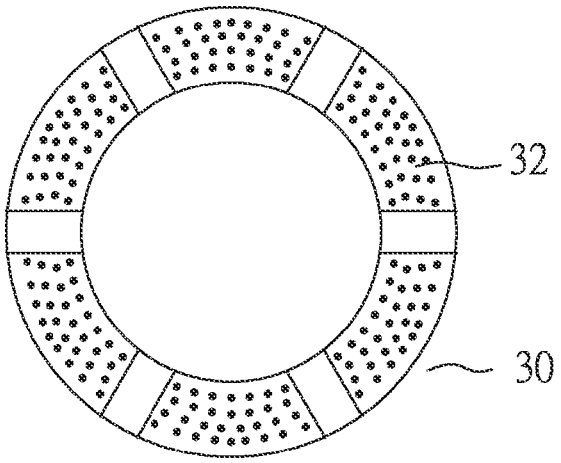
FIGS. 4A to 4B show schematic diagrams of the chemical mechanical polishing conditioners of example 2 and example 3 of the present invention.
Figure 4B:
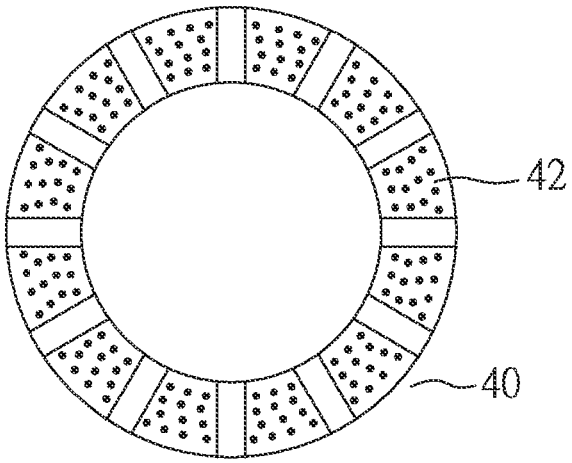

Please refer to FIGS. 4A and 4B, schematic diagrams of the chemical mechanical polishing conditioners of example 2 and example 3 of the present invention are shown. The manufacturing process of Example 2 and Example 3 are substantially the same as the above Example 1, except that the numbers of the abrasive units arranged on the abrasive unit binding layer are different. In Example 2, there are six abrasive units 32 arranged on the surface of the abrasive unit binging layer (not shown in figure) to form a discontinuous circular contour, as shown in FIG. 4A. In Example 3, there are twelve abrasive units 42 arranged on the surface of the abrasive unit binging layer (not shown in figure) to form a discontinuous circular contour, as shown in FIG. 4B.

It should be understood that these examples are merely illustrative of the present invention and the scope of the invention should not be construed to be defined thereby, and the scope of the present invention will be limited only by the appended claims.

What is claimed is:

1. A segment-type chemical mechanical polishing conditioner, comprising:

a bottom substrate having a center protrusion;

an abrasive unit binding layer disposed on an outside of a surface of the bottom substrate; and a plurality of abrasive units disposed on the abrasive unit binding layer;

wherein the abrasive units have a fan-shaped contour and are arranged along the center protrusion of the bottom substrate to form a discontinuous circular contour.

2. The segment-type chemical mechanical polishing conditioner of claim 1, wherein the surface of the abrasive unit binding layer has four to fifty abrasive units.

3. The segment-type chemical mechanical polishing conditioner of claim 1, wherein the abrasive units have a positive camber and a negative camber, and a width between the positive camber and the negative camber is 5 mm to 20 mm.

4. The segment-type chemical mechanical polishing conditioner of claim 1, wherein a diameter of the bottom substrate is 70 mm to 200 mm.

5. The segment-type chemical mechanical polishing conditioner of claim 1, wherein a height of the center protrusion is ⅕ to ⅘ of a height of the abrasive units.

6. The segment-type diameter chemical mechanical polishing conditioner of claim 1, wherein each abrasive unit has a plurality of abrasive particles, an abrasive particle binding layer and an abrasive unit substrate.

7. The segment-type chemical mechanical polishing conditioner of claim 6, wherein these abrasive particles are embedded in the abrasive particle binding layer, and theses abrasive particles are fixed to the abrasive unit substrate by the abrasive particle binding layer.

8. The segment-type chemical mechanical polishing conditioner of claim 6, wherein the abrasive particles are artificial diamond, nature diamond, polycrystalline diamond or cubic boron nitride.

9. The segment-type chemical mechanical polishing conditioner of claim 6, wherein the abrasive particles have a particle size of 30 μm to 600 μm.

10. The segment-type chemical mechanical polishing conditioner of claim 1, wherein the abrasive unit binding layer is a brazing layer, a resin layer, a electroplating layer, or a ceramic layer.

11. The segment-type chemical mechanical polishing conditioner of claim 6, wherein the abrasive particle binding layer is a brazing layer, a resin layer, a electroplating layer, or a ceramic layer.

12. The segment-type chemical mechanical polishing conditioner of claim 11, wherein the abrasive particle binding layer is a brazing layer, and the brazing layer is at least one selected from the group consisting of iron, cobalt, nickel, chromium, manganese, silicon, aluminum, and combinations thereof.

13. The segment-type chemical mechanical polishing conditioner of claim 10, wherein the abrasive unit binding layer is a resin layer, and the resin layer is an epoxy resin.

14. A method for manufacturing a segment-type chemical mechanical polishing conditioner, comprising:

providing a bottom substrate having a center protrusion;

providing an abrasive unit binding layer disposed on an outside of a surface of the bottom substrate;

disposing a locating tool having a plurality of locating blocks on the center protrusion;

providing a plurality of abrasive units arranged on the abrasive unit binding layer by the locating tool;

heat-curing the abrasive unit binding layer, such that the these abrasive unit binding layer is fixed to the abrasive unit binding layer; and removing the locating tool to form a segment-type chemical mechanical polishing conditioner;

wherein the abrasive units have a fan-shaped contour and are arranged along the center protrusion of the bottom substrate to form a discontinuous circular contour.

15. The method for manufacturing the segment-type chemical mechanical polishing conditioner of claim 14, wherein each abrasive unit has a plurality of abrasive particles, an abrasive particle binding layer and an abrasive unit substrate.

16. The method for manufacturing the segment-type chemical mechanical polishing conditioner of claim 14, wherein a heat-curing method of the abrasive unit binding layer is a brazing method heat-hardening method, ultraviolet radiation curing method, electroplating method, or sintering method.

17. The method for manufacturing the segment-type chemical mechanical polishing conditioner of claim 15, wherein a heat-curing method of the abrasive particle binding layer is a brazing method heat-hardening method, ultraviolet radiation curing method, electroplating method, or sintering method.

18. The method for manufacturing the segment-type chemical mechanical polishing conditioner of claim 17, wherein the heat-curing method of the abrasive particle binding layer is the brazing method.

19. The method for manufacturing the segment-type chemical mechanical polishing conditioner of claim 16, wherein the heat-curing method of the abrasive unit hinging layer is the heat-hardening method.

* * * * *